United States Patent [19]

Bareis et al.

[11] 4,075,723

[45] Feb. 28, 1978

[54] BOAT COVER MEANS

[75] Inventors: Marvin A. Bareis, New Haven, Mo.; George C. Nisbet, Mount Prospect, Ill.

[73] Assignee: Kellwood Company, St. Louis, Mo.

[21] Appl. No.: 724,711

[22] Filed: Sep. 20, 1976

[51] Int. Cl.[2] ..... B63B 17/02

[52] U.S. Cl. ..... 9/1.5; 135/6; 135/15 CF; 135/DIG. 1

[58] Field of Search ..... 9/1.5, 1.1; 135/6, 7.1 R, 135/15 CF, DIG. 1, DIG. 5, DIG. 6; 296/109, 118, 43; 4/172.11, 172.12; 5/121, 362, 364; 244/153 R

[56] References Cited

U.S. PATENT DOCUMENTS

| | | | |
|---|---|---|---|
| 659,981 | 10/1900 | McCall | 135/15 CF |
| 1,177,625 | 4/1916 | Hopper | 135/6 |
| 1,414,616 | 5/1922 | Beehler | 135/DIG. 1 |
| 2,484,096 | 10/1949 | Kay | 244/153 R |
| 2,811,728 | 11/1957 | Litsheim | 9/1.5 |
| 3,198,200 | 8/1965 | Sanders | 135/DIG. 1 |
| 3,226,066 | 12/1965 | Folb | 9/1.5 |
| 3,896,832 | 7/1975 | Montoya | 135/6 |
| 3,929,146 | 12/1975 | Maiken | 135/15 CF |

OTHER PUBLICATIONS

1975 Sears, Roebuck & Company Catalog, p. 39, "Boating and Fishing '75," cited by Applicants.

*Primary Examiner*—Trygve M. Blix
*Assistant Examiner*—Charles E. Frankfort
*Attorney, Agent, or Firm*—Koenig, Senniger, Powers and Leavitt

[57] ABSTRACT

A cover of flexible sheet material and a flexible resilient rib adapted to extend in arched configuration over a boat from adjacent one gunwale of the boat to the other for supporting the cover arched over the boat. The rib is secured to the cover with the cover extending down beyond the ends of the rib and then down on the sides of the boat for securement over the boat. The rib may be bent into various arched configurations depending on the beam of the boat, and then held in any of the arched configurations.

7 Claims, 4 Drawing Figures

BOAT COVER MEANS

BACKGROUND OF THE INVENTION

This invention relates to boat cover means and particularly to boat cover means comprising a cover and a rib for supporting the cover arched over a boat.

The invention is in the field of boat cover means involving support for a boat cover in an arched configuration over the boat such as shown, for example, on page 39 of the 1975 Sears, Roebuck & Co. catalog entitled "Boating & Fishing '75." Heretofore the cover support has usually been constituted by upwardly arched flexible slats or the like extending transversely of the boat to support the cover with the slats requiring sockets or similar type fittings installed on the inside of the gunwales of the boat to receive the ends of the slats.

SUMMARY OF THE INVENTION

Among the several objects of this invention may be noted the provision of improved boat cover means which does not require the installation of any sockets or fittings on the boat; the provision of such cover means which is adapted to fit a variety of boats of different widths; and the provision of such cover means which is economical to manufacture and which may be quickly and easily mounted on a boat.

Briefly, a boat cover means of this invention comprises a cover of flexible sheet material and flexible resilient rib which is adapted to extend in arched configuration over a boat from adjacent one gunwale of the boat to the other for supporting the cover arched over the boat. Means is provided for securing the rib to the cover with the cover extending down beyond the ends of the rib and down on the sides of the boat. The rib is adapted to be bent to various arched configurations depending on the beam of the boat on which the boat cover is used in the transverse plane of the boat where the rib is located. The boat cover means of the present invention further includes means attached to the cover for holding the rib in any of said arched configurations, and means for fastening the cover to the boat.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
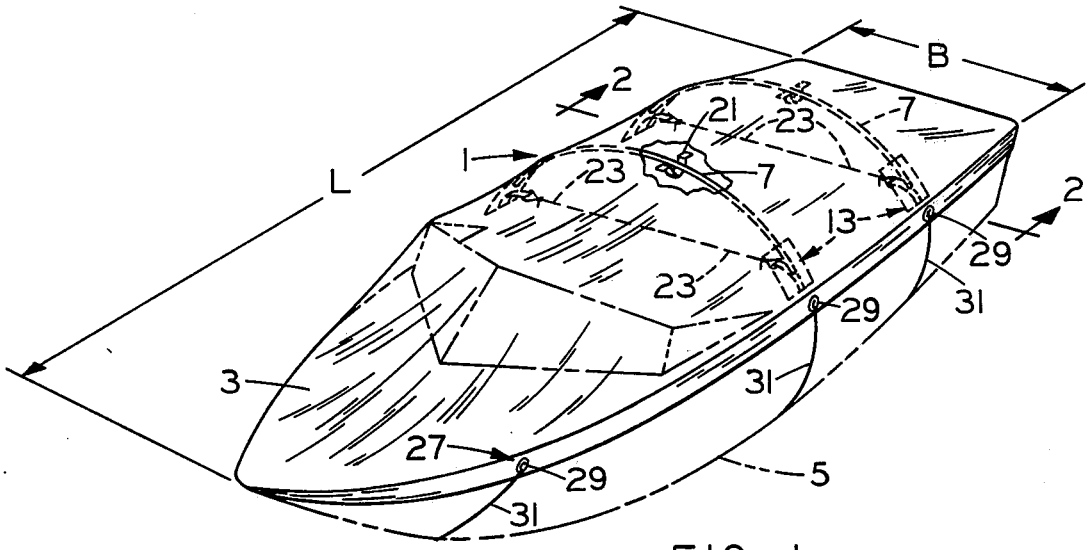
FIG. 1 is a perspective of a boat covered by a boat cover means of this invention.

Referring to the drawing, a boat cover means of the present invention, indicated in its entirety by the reference numeral 1, is shown to comprise a cover 3 of flexible sheet material (e.g., water-resistant vinyl-coated nylon) for covering a boat 5 having a length L and a beam B. Two flexible resilient ribs or rods each designated 7 are secured to the cover 3 and extend beneath the cover in arched configuration over the boat from adjacent one gunwale 9 of the boat to the other gunwale 11. The rods 7 support the cover 3 arched over the boat, the arched configuration of the cover being particularly effective for shedding water.

Each rod 7 is preferably made of fiberglass (although other commercially available flexible materials may also be suiable) so that the rod may be easily bent into its proper arched configuration over boat 5 in which the ends of the rod are adjacent the gunwales 9, 11. Both rods are also preferably made up of a series of interconnected sections (not shown in the drawing) which may be readily disconnected upon dismantling the boat cover means 1. While only two rods are shown in the drawing for supporting cover 3, it will, of course, be understood that the number of of rods 7 needed for properly supporting the cover over the boat 5 will depend upon the length L of the boat. As a general rule, the rods should be spaced approximately 4 feet apart.

Figure 2:
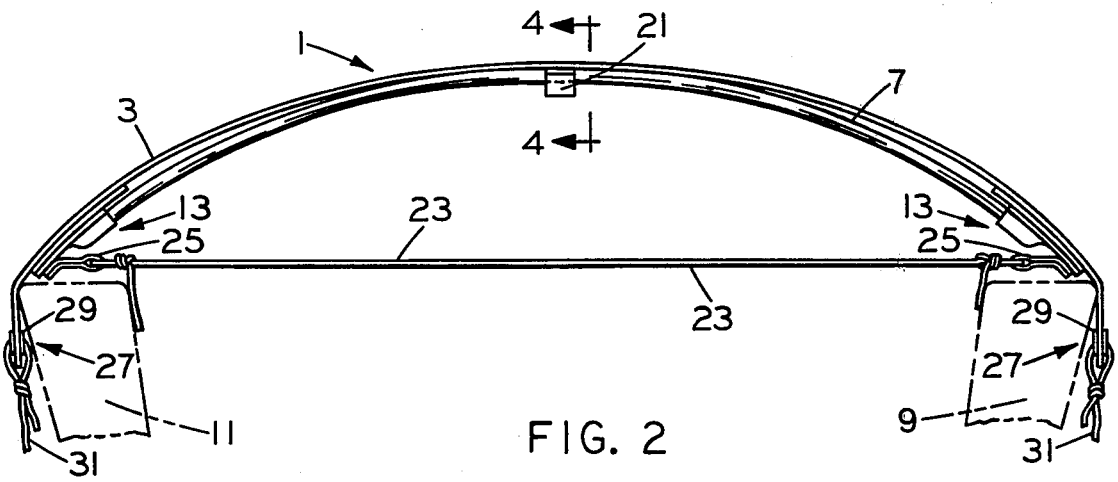
FIG. 2 is a horizontal section on line 2—2 of FIG. 1.
Figure 3:
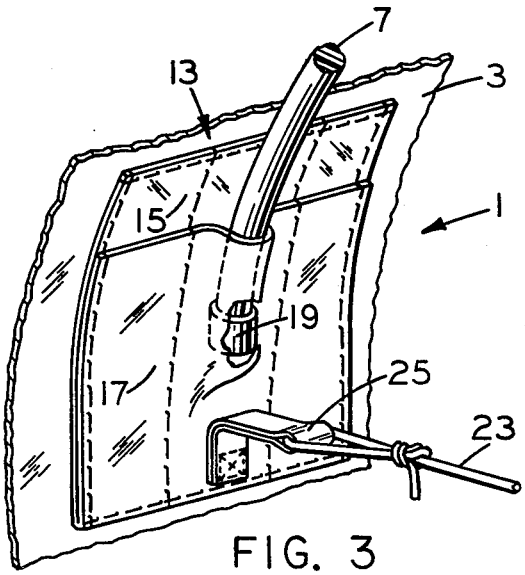
FIG. 3 is an enlarged view of a portion of the cover and a rod for supporting the cover.

Four pockets (two per rod), each designated 13, on the inside of the cover 3 comprise means for securing the two rods 7 to the cover with the cover extending down beyond the ends of the rods on the sides of the boat. As best shown in FIGS. 2 and 3, the ends of each rod 7 are received in pockets 13 located at opposite sides of the cover 3 adjacent the gunwales 9, 11 when the cover is in its arched configuration over the boat. Each pocket 13 has a back 15 and a front 17 of relatively heavy-duty vinyl-coated nylon or the like and is secured (e.g., by stitching) to the inside of the cover 3. A protective tip 19 on each end of the rod 7 prevents the end of the rod from punching through the pocket.

Figure 4:
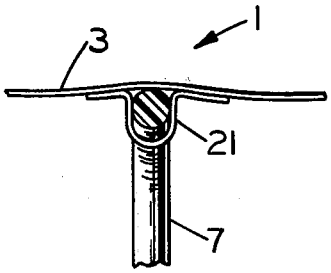
FIG. 4 is a vertical section on lone 4—4 of FIG. 2.

Each rod 7 is further secured to cover 3 by means of a loop 21 at the center of the cover (see FIGS. 2 and 4) through which the rod extends for holding the rod in fixed position relative to the cover (i.e., for preventing the rod from tilting toward the stern or bow of the boat).

A cord 23 of nylon or other suitable material extends between each pair of opposing pockets 13 and comprises means for bending a rod 7 within the pockets upwardly to its proper arched configuration (depending upon the beam B of the boat) and then holding the rod in that position. More particularly, a loop 25 is provided on each pocket 13 for receiving the cord 23, this loope being sewn or otherwise attached to the lower part of each pocket 13 (although it is understood that the loop could also be secured to the cover 3 in other suitable locations adjacent the pocket). With one end of the cord 23 tied to a loop 25, the rod 7 is arched upwardly by pulling the other end of the cord 23 through the loop on the opposing pocket at the opposite side of the cover 3 until both pockets, with the ends of the rod therein, are properly positioned adjacent gunwales 9,11. The cord is then tied or otherwise secured in this position (e.g., via a hook) as shown in FIG. 2. Thus, the rod 7 and cover 3 are held arched over the boat without having to install sockets or other fixtures on the boat or in any way modify the boat. Moreover, it will be understood that by bending the rods 7 to any of various arched configurations, a variety of boats of different widths may be covered by boat cover means 1.

For fastening the cover in its arched configuration to the boat, means generally indicated at 27 is provided. This fastening means 27 includes a plurality of grommets, each designated 29, in the side margins of the cover extending down on the sides of the boat. As illustrated in FIG. 2, ropes 31 pass beneath the boat and are removably secured at their ends to these grommets for holding the cover on the boat. The grommets are preferably located directly beneath the pockets 13 as this has been found to be the best position for supporting the rods 7 in their upright position. It will, of course, be understood that the cover 3 may be suitably secured to the boat 5 by other means without departing from the scope of this invention.

The improved boat cover means of this invention enables a boat to be covered without the installation of any sockets or fittings or modifying the boat in any manner whatsoever. Moreover, the boat cover is readily adjustable for fitting a variety of boats of different widths, thus reducing the number of boat cover sizes which need to be stocked. The simple design of this invention also assures quick and easy installation and economical manufacture for reduced cost.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. Boat cover means comprising:

a cover of flexible sheet material;

a flexible resilient rib constituting a cover support adapted to extend in arched configuration over a boat from adjacent one gunwale of the boat to the other for supporting the cover arched over the boat;

a pair of pockets on the inside of the cover at opposite sides thereof for receiving the ends of the rib thereby to secure said rib to the cover with the cover extending down beyond the ends of said rib on the sides of the boat;

said rib being adapted to be bent to various arched configurations depending on the beam of the boat on which the boat cover means is used in the transverse plane of the boat where the rib is located and said cover having means attached thereto for holding the rib in any of said arched configurations; and means for fastening the cover to the boat.

2. Boat cover means as set forth in claim 1 wherein said rib comprises a fiberglass rod.

3. Boat cover means as set forth in claim 1 wherein said holding means comprises cord means adapted to extend between the pockets.

4. Boat cover means as set forth in claim 3 wherein each pocket has a loop attached thereto and said cord means comprises a cord adapted to extend between the pockets and to be secured to said loops.

5. Boat cover means as set forth in claim 4 wherein said securing means further comprises a loop generally at the center of the cover for receiving and holding the rib in a fixed position relative to the cover.

6. Boat cover means as set forth in claim 1 wherein said fastening means comprises rope means adapted to be attached to the cover for securing the cover on the boat.

7. Boat cover means as set forth in claim 6 wherein said rope means comprises at least one rope adapted to pass transversely beneath the boat and to be secured at its ends to portions of the cover adjacent said securing means.

* * * * *